United States Patent [19]

Brackhahn et al.

[11] Patent Number: 4,598,341

[45] Date of Patent: Jul. 1, 1986

[54] DISPLAY CASE LIGHTING SYSTEM

[75] Inventors: Virgil D. Brackhahn; Gary W. Cook, both of Beatrice, Nebr.

[73] Assignee: Storekraft Manufacturing Co., Beatrice, Nebr.

[21] Appl. No.: 723,892

[22] Filed: Apr. 16, 1985

[51] Int. Cl.[4] ..... A47F 11/10; F21S 3/02

[52] U.S. Cl. ..... 362/125; 362/133; 362/219; 362/249

[58] Field of Search ..... 362/125, 126, 133, 154, 362/219, 249; 312/114, 213

[56] References Cited

U.S. PATENT DOCUMENTS

| | | | |
|---|---|---|---|
| 2,163,562 | 6/1939 | Putnam et al. | 362/125 X |
| 2,336,416 | 12/1943 | Parker | 362/125 |
| 2,569,934 | 10/1951 | Kurtzon | 362/125 |
| 4,471,415 | 9/1984 | Larson et al. | 362/249 X |
| 4,535,393 | 8/1985 | Aspenwall | 362/125 X |

FOREIGN PATENT DOCUMENTS

| | | | |
|---|---|---|---|
| 199301 | 10/1938 | Switzerland | 362/125 |

OTHER PUBLICATIONS

North American Philips Lighting Corporation, product brochure "The PL*Lamp", 3 pages and 1 page attachment, ©1983.

GTE Products Corp., product advertisement "Latest Lamp Innovations", p. 43, of unknown, undated publicat, lower right item.

Leviton Manufacturing Co., Inc., sales bulletin 218, "New Complete Line of PL Lampholders", 4 pages, ©1983.

Radonic Industries, Inc., product brochure "PL Lamp Ballast", 2 pages, undated.

*Primary Examiner*—Tony M. Argenbright

*Attorney, Agent, or Firm*—Cushman, Darby & Cushman

[57] ABSTRACT

A display case for jewelry or the like, having glazed front and top windows into a display space typically having a lockable mirrored sliding door back wall and a fabric-covered floor pad above an obscured storage space, has a shell construction mounted in the case so that it extends from end to end of the case in the upper front corner. The shell construction includes two opposed channels in which reflector panels mounting lamp holders for a requisite number of single base compact fluorescent lamps are slidingly received so as to form with the shell construction the hypotenuse of a triangular space serving as a raceway for the wiring of the lamp holders. At one end the collected wiring is directed down through a groove or raceway formed in or on one of the endwalls of the case, and into the obscured storage or base region of the case. Here, the wiring connects with a ballast assembly for the lamps. The ballast assembly, in turn, is provided with a power line emerging to the exterior with a plug for plugging to an electrical receptacle, or for plugging into a unit of another case for instances where several display cases are to be ganged together and electricity fed through the coupled electrical systems of two or more of them to reach the lighting systems of cases which are located remote from an electrical outlet.

7 Claims, 13 Drawing Figures

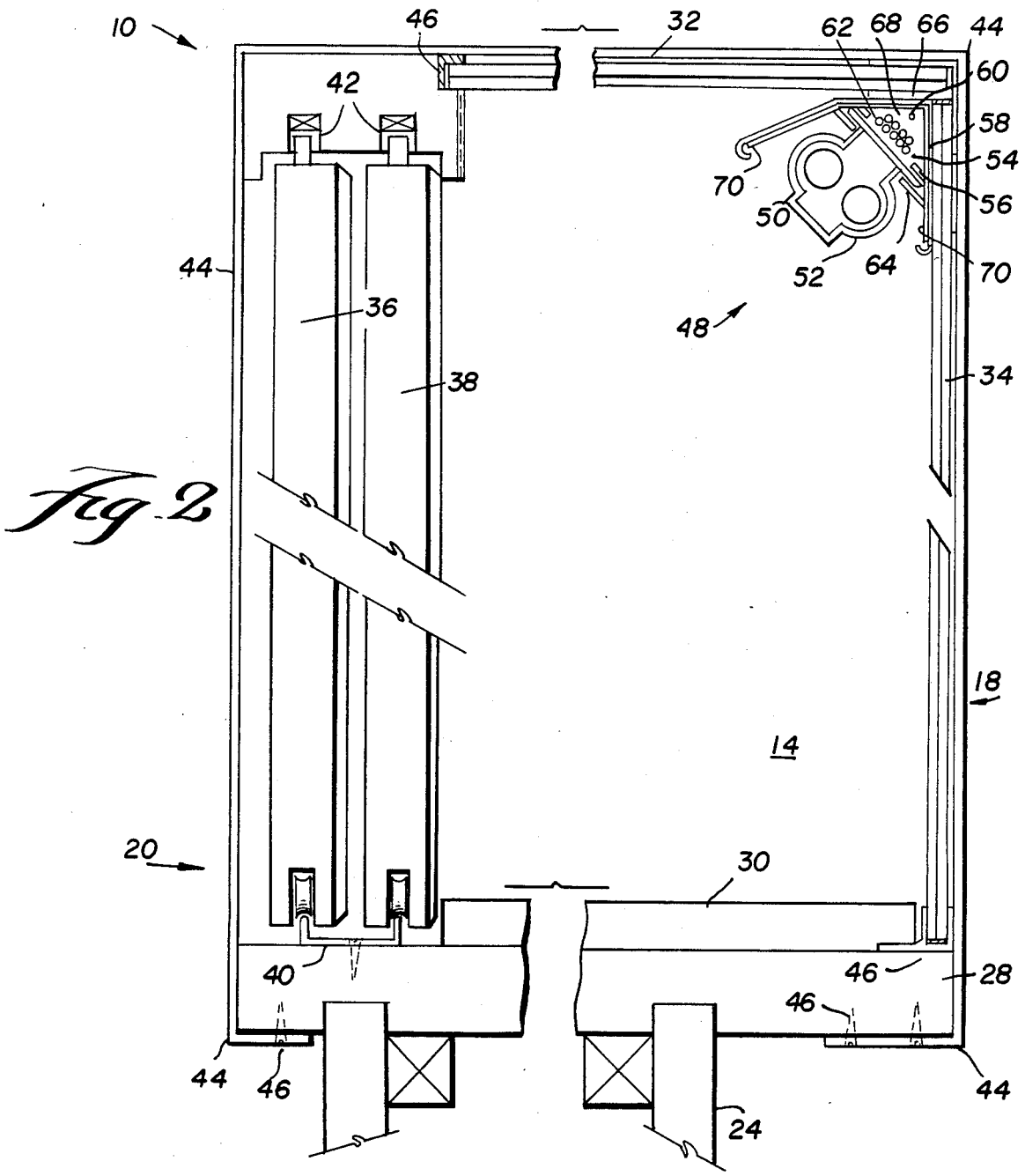
Fig. 2
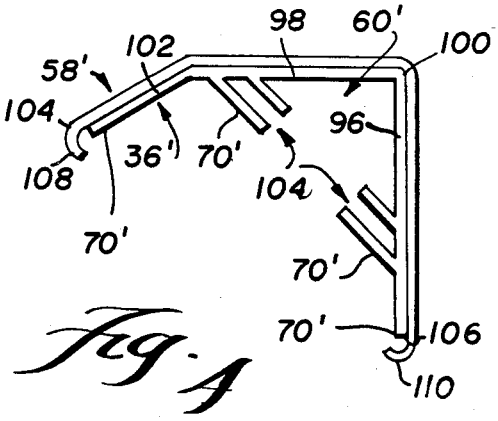
Fig. 4
Fig. 5
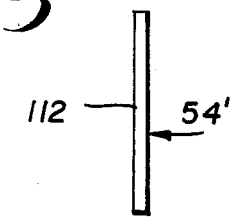

DISPLAY CASE LIGHTING SYSTEM

BACKGROUND OF THE INVENTION

It is well-known that jewelry and certain other items are particularly attractive in appearance when they are brilliantly lit while on display, e.g. in a display case. Heretofore, arranging for lighting of such display cases has been a problem; high intentisy incandescent lighting produced much unwanted heat which in some instances required forced ventilation of display cases and in others caused premature deterioration of interior components and display materials such as glue, paper, fabric and the like, due to the hot, dry conditions within the display case. Evenness of lighting has been a problem; even with the use of diffusers and reflectors, certain regions of the display area within typical cases were apparently more brightly lit. In some instances, the cost of electricity for powering the lighting and the cost of replacing spent bulbs has been considered excessive. Conventional fluorescent lighting heretofore available has not proved to be an adequate solution of the problems; though they generate less heat, usually the level of illumination they provide does not permit brilliant lighting e.g. for jewelry displays and the like, and sometimes the hue of the standard fluorescent lighting is not so complementary to the merchandise.

Recently, several lamp manufacturers have come out with compact fluorescent lamps which differ from heretofore conventional straight line fluorescent tubes having a base at each end, in that on these new lamps, the tube is folded-over mid-way along its length, so that both ends share the same lamp base in common, much as do conventional incandescent light bulbs.

Such compact fluorescent lamps are available in the U.S., e.g. from North American Philips Lighting Corporation, of Bloomfield, N.J. under the "Norelco" brand name as "PL" lamps in 7-, 9-and 13-watt sizes. Lampholders are available in the U.S. for such lamps, e.g. from Leviton Manufacturing Co., Inc., of Little Neck, N.Y., e.g. as its series 26720 for the 13-watt lamps, catalog No. 26720-2 being its horizontal screw or slide-on mount lamp holder for the 13-watt lamps. Lamp ballasts for such lamps and lamp holders, not requiring starters, have become available in the U.S., e.g. from Radonic Industries, Inc. of Chicago, Ill., catalog No. C452 being its designation for a ballast, having a Q-style case, for serving such a lamp and lamp holder.

Similar lamps are available in the U.S., from the manufacturer of "Sylvania" brand light bulbs, under the designation Compact TT twin tube fluorescents.

For the Norelco lamps, lamp holders (sockets) are also available from Kulka Wiring Devices, Inc., of Mt. Vernon, N.Y. and Edwin Gaynor Company, of Stratford, Conn.; and lamp ballasts are also available from Advance Transformer Company, of Chicago, Ill., Robertson Transformer Company, of Blue Island, Ill., Universal Manufacturing Corporation, of Paramus, N.J., and Keystone Transformer Company, of Pennsburg, Pa.

The new form of lighting, herein designated single base compact fluorescent lamp lighting is said by the lamp manufacturer to combine in one lamp: high efficiency (up to 69.2 lumens per watt, so that a 13-watt lamp provides up to 900 lumens and can replace a 60-75-watt conventional lighting source at an up to 77 percent energy cost saving); a color temperature of 2700° K. (that is similar to the 2750° K. color temperature of a standard incandescent lamp so that it reflects color in a 'warm' way that is more characteristic of natural sunlight and of incandescent lighting, than of conventional fluorescent lighting); long life (about ten-times that of the 1000-hour average for a conventional incandescent bulb of comparable illumination level); low radio interference; ability to start at low temperature; and a differentiation in base/socket design for the 13-watt size compared with the smaller wattage lamps, so one may by providing a particular socket ensure that lamps of a particular wattage are used. The manufacturers of these lamps have recognized that cabinet fixtures can be reduced in size and less materials used in manufacture when single base compact fluorescent lamps are used for their display space lighting. However, heretofore, to the present inventors' knowledge, display case designers have not taken anywhere near full advantage of this new case-lighting possibility, either for new cases or for retrofitting of existing cases.

SUMMARY OF THE INVENTION

A display case for jewelry or the like, having glazed front and top windows into a display space typically having a lockable mirrored sliding door back wall and a fabric-covered floor pad above an obscured storage space, has a shell construction mounted in the case so that it extends from end to end of the case in the upper front corner. The shell construction includes two opposed channels in which reflector panels mounting lamp holder for a requisite number of single base compact fluorescent lamps are slidingly received so as to form with the shell construction the hypotenuse of a triangular space serving as a raceway for the wiring of the lamp holders. At one end the collected wiring is directed down through a groove or raceway formed in or on one of the endwalls of the case, and into the obscured storage or base region of the case. Here, the wiring connects with a ballast assembly for the lamps. The ballast assembly, in turn, is provided with a power line emerging to the exterior with a plug for plugging to an electrical receptacle, or for plugging into a unit of another case for instances where several display cases are to be ganged together and electricity fed through the coupled electrical systems of two or more of them to reach the lighting systems of cases which are located remote from an electrical outlet.

The principles of the invention will be further discussed with reference to the drawings wherein preferred embodiments are shown. The specifics illustrated in the drawings are intended to exemplify, rather than limit, aspects of the invention as defined in the claims.

BRIEF DESCRIPTION OF THE DRAWINGS

In the Drawings

FIG. 2 is a fragmentary vertical transverse cross-sectional view of the upper, front portion of the case of FIG. 1 on a larger scale;

FIG. 4 is an end view of the assembled shells thereof;

FIG. 5 is an end view of a reflector/mounting plate insert thereof;

DETAILED DESCRIPTION

Figure 1:
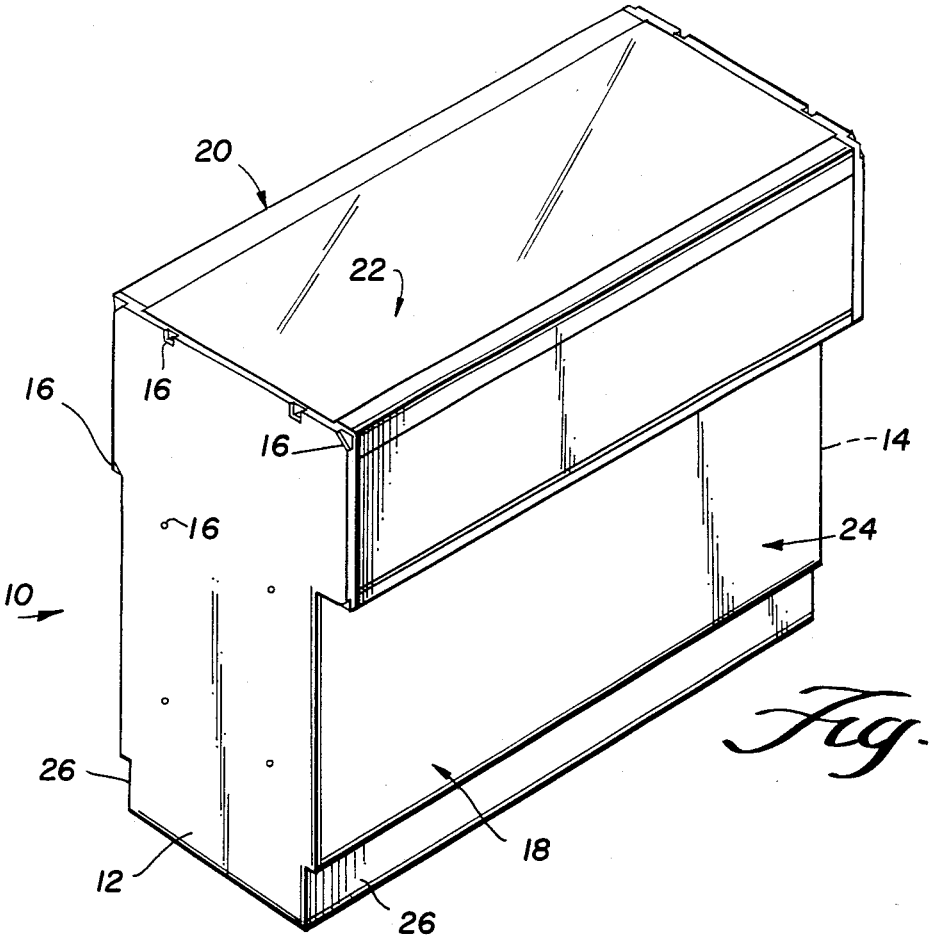
FIG. 1 is a small scale perspective view of a display case provided with a lighting system embodying principles of the present inventiion.
Figure 12:
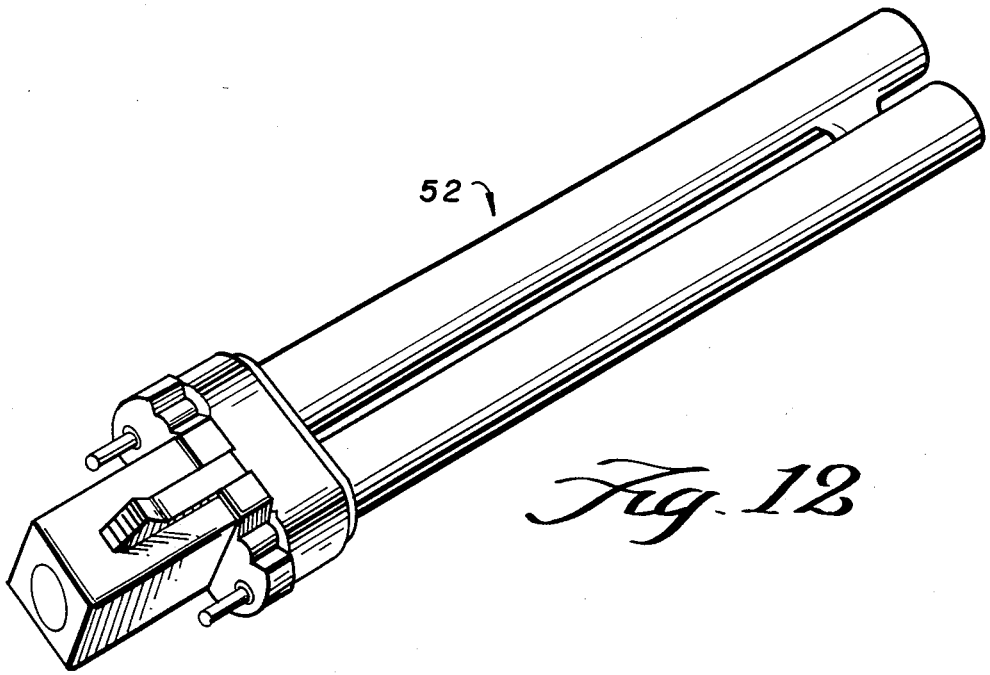
FIG. 12 is a perspective view of a single base compact fluorescent lamp useful therein.

A display case is shown at 10 in FIGS. 1 and 2. In the instance depicted, the case 10 is constructed and arranged for displaying jewelry, e.g. at a department store, jewelry store or catalog showroom. The invention is not limited to use for such a purpose or in such an environment, e.g. it may be used for displaying artifacts in a museum or gourmet foods in a delicatessen. However, it was designed especially for displaying merchandise which appears most attractive when brilliantly lit. Although the display case 10 is a newly-designed case, the lighting system of the invention is equally adaptable to the retrofitting of existing cases.

The typical display case 10 has vertical end walls 12, 14 either or both of which may be finished, or equipped, as shown, to be abutted with other similar cases and secured thereto to provide an elongated bank or counter of display cases. In the instance depicted, the endwall features 16 are provided for connecting the case 10 end to end with another similar case (not shown); these features are exemplary and non-essential.

For orientation purposes, let 18 indicate the front or customer side of the case 10, and 20 indicate the rear or clerical side of the case 10; the upper portion which is shown jutting out to the front houses the display space 22, the lower portion which may be opaque-walled may house a storage space 24 containing one or more shelves, drawers, bins and/or the like (not shown). The left and right ends of the case are arbitrarily designated from the perspective of the clerk, e.g. the right end is shown foremost in FIG. 1. At the level of the upper extent of the kick panels 26 a storage space floor (not shown) may be provided. At the juncture of the storage space and the display space, a horizontal panel 28 may be provided which serves as the floor of display space. Within the display space, a pad 30, e.g. a felt-covered, velvet-covered panel or the like may be provided as a background or base for displaying jewelry or other items (not shown) within the case.

Typically, the top wall is glazed, e.g. with a panel of laminated safety glass 32 such as Sierracin anti-penetration glazing, as is the front wall at 34. The rear wall of the display space may be provided by any convenient means such as mirror fronted, lockable sliding doors 36, 38 running at the bottom on track means 40 and at the top in slot means 42. End panel hoops 44 of finishing metal (not shown in FIG. 1) provide finishing for the ends of the case and/or transitional means to integrate endwise adjoining cases. Typical structures 46 may be provided for fastening parts of the case together.

In FIG. 2, a typical embodiment of the lighting system of the present invention is generally illustrated at 48. In this embodiment, the system is shown including socket means 50 for one or more single base compact fluorescent lamps 52 mounted to an insert means 54 of an inner shell 56 which is mounted to an outer shell 58 in such a way as to define with the upper and front flanges of the outer shell 58 a raceway 60 for the wiring 62 to the socket means 50. At the opposite end walls of the case, the shell means 56/58 is supported by end brackets 64, and along its length, the shell means 56/58 is shown supported by a cover tee assembly 66 which preferably fits between the top and front window glazing panels and hooks upwards around the front and top front edge margin of the top glazing panel, as shown. The outer shell 58 is shown secured, e.g. by screws 68 to the central, horizontal, rearwardly projecting base flange of the cover tee assembly 66, so that the frontally depending vertical flange of the outer shell cooperates with the frontally depending vertical flange of the cover tee assembly 66 to secure the upper marginal edge of the front window panel of the display case. The surfaces 70 of the shell means which are exposed toward the lamp(s) preferably are mirror finished to serve as reflector means. The front and top flanges of the outer shell 58 extend far enough to shield the customer and clerk from having to look directly at the lamp(s), when the customer and clerk are disposed in normal being waited-on, and waiting-on positions, respectively, yet provide a finished look which masks their function. As should be apparent, the lighting system 48 occupies a practical minimum of the display space of the case and permits maximum visibility to the customer of attractively lit merchandise within the display space. (Although not shown in FIGS. 1 or 2, the lighting system 48 further comprises a ballast assembly for the lamps, which assembly may be located out of sight down in the storage or base areas of the case 10, with the wiring 62 extending from one end of the raceway 60, down through a raceway or covered groove, to the ballast assembly. The details which are not shown in FIGS. 1 and 2 are shown, and further described below, for the preferred embodiment that is illustrated in FIGS. 3–13. The components which are shown in FIGS. 1 and 2 which have a somewhat different structure in the preferred embodiment are designated with a like numeral, to which a prime has been added.

Figure 3:
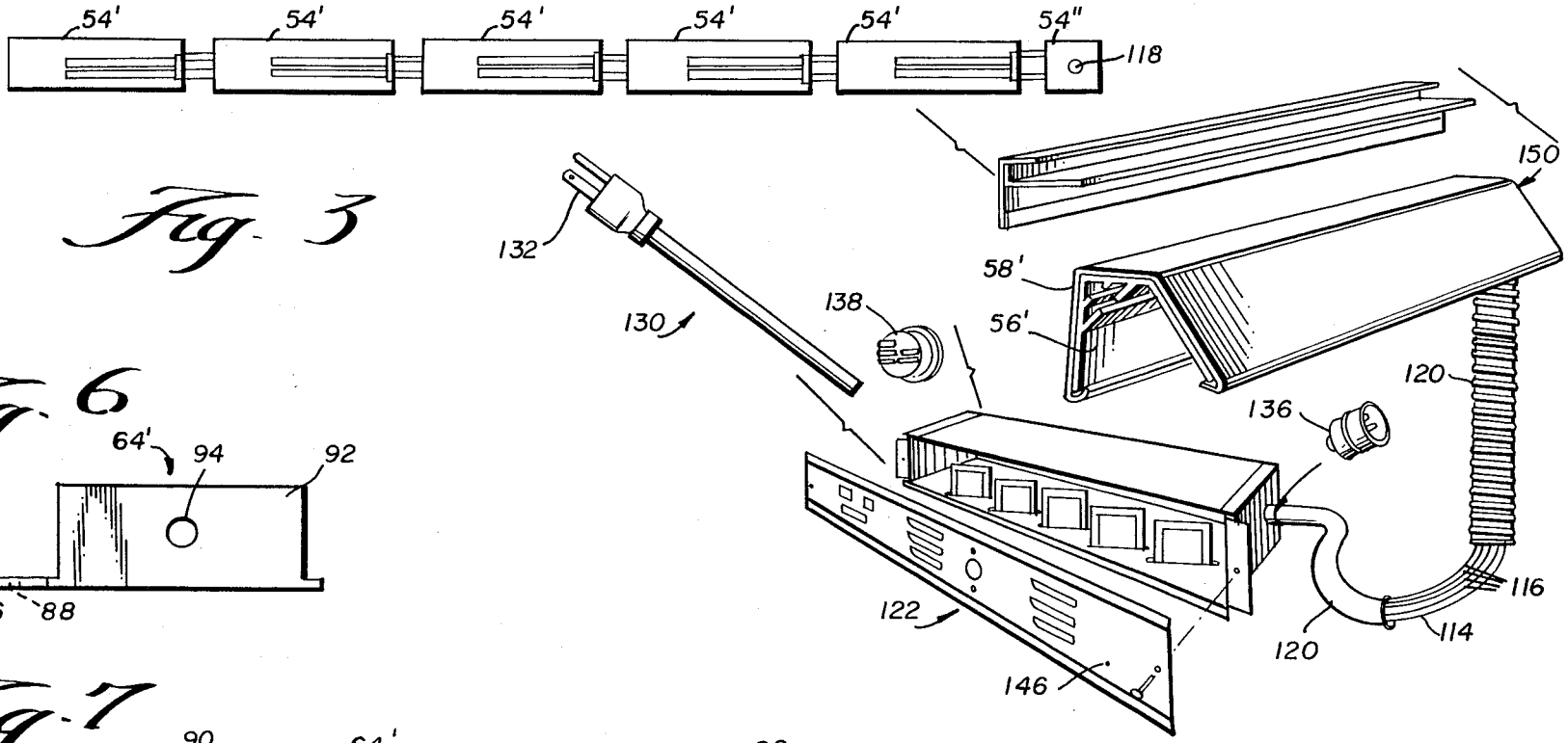
FIG. 3 is an exploded perspective view of a presently preferred embodiment of the lighting system.

The embodiment 48' shown in exploded perspective view in FIG. 3 is constructed and arranged to provide lighting for a five foot long display case, with one 13-watt single base compact fluorescent lamp 52 provided for each foot of case. A preferred system for a shorter or longer case would be provided with correspondingly fewer or more lamps 52.

In FIGS. 3 and 9–11, cover tee assembly is shown at 66'. Typically it is fabricated in two pieces, as shown, which are welded or adhered together to provide a unitary member having a centrally located, rearwardly projecting flange 72 provided with a series of holes 74 vertically through its thickness for mounting the shell assembly 56'/58' and end brackets 64' thereto. The cover tee assembly 66' further includes a vertical front flange 76 the rear face of which is mounted to the forward end of the central flange 72 at 78. An upper marginal portion of frontal flange 76 is angled rearwards at 80 provide a horizontal top flange 82 which parallels the central flange 72, but preferably does not extend so far to the rear. The flanges just described define between them a rearwardly open slot 84 for receiving and holding the forward edge margin of the top glass 32 of the display case 10 (FIGS. 1 and 2). The depending portion 86 of the frontal flange 76 is designed to form the outer element of a similar downwardly opening groove for receiving the upper edge margin of the front glass 34 of the display case 10 (FIGS. 1 and 2), with a portion of the shell assembly 56/58 forming the inner flange of such channel. The cover tee assembly 66' preferably is made of stainless steel, and its surfaces which will be visible in the assembled structure preferably are finished, e.g. by being mirror-polished.

Figure 8:
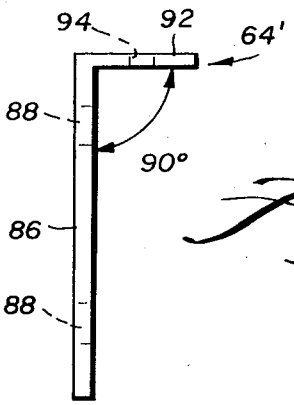
FIGS. 6, 7 and 8 are respective top plan, outside elevational and front elevational views of a right end attaching plate for the shell assembly.
Figure 6:
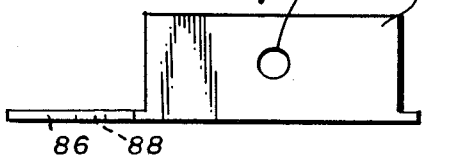
Figure 7:
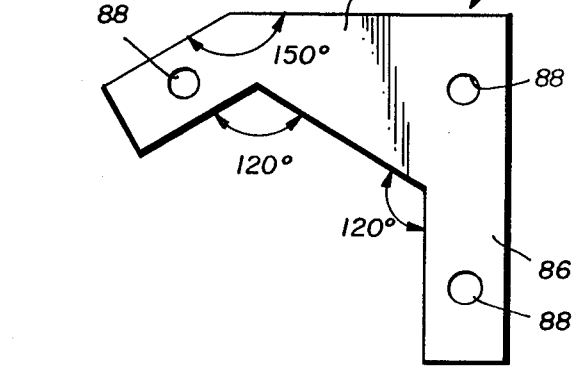
Figure 13:
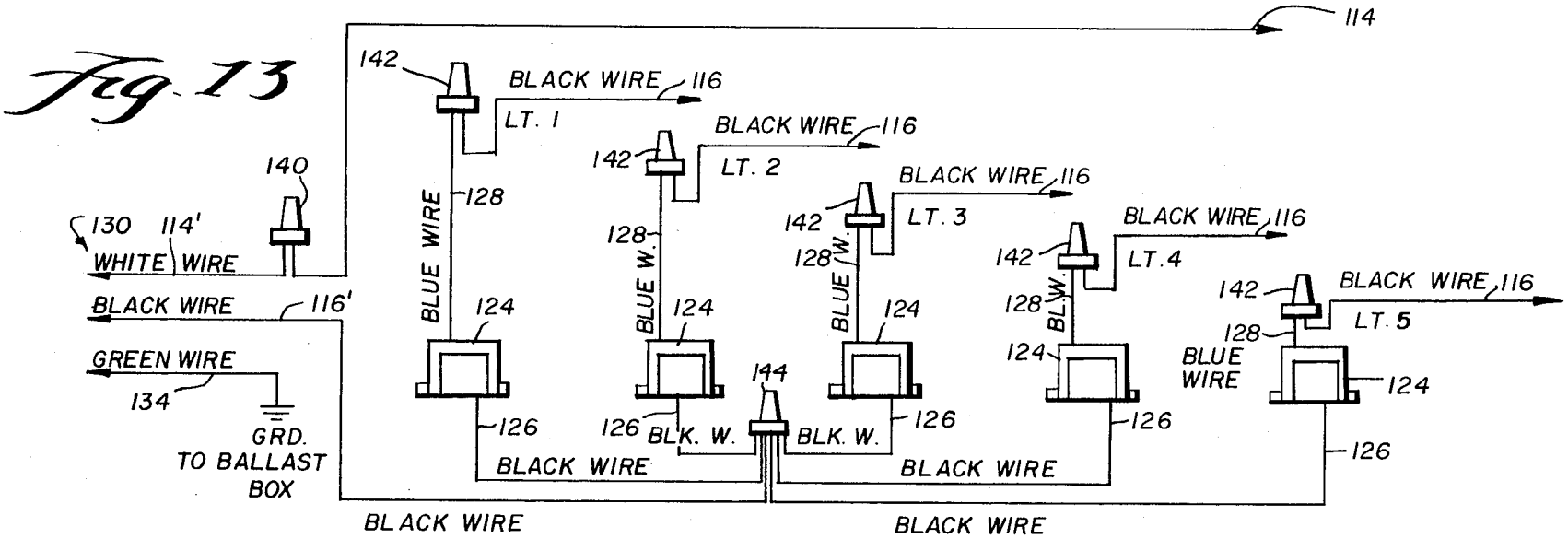
FIG. 13 is a schematic wiring diagram of the system.
Figure 9:
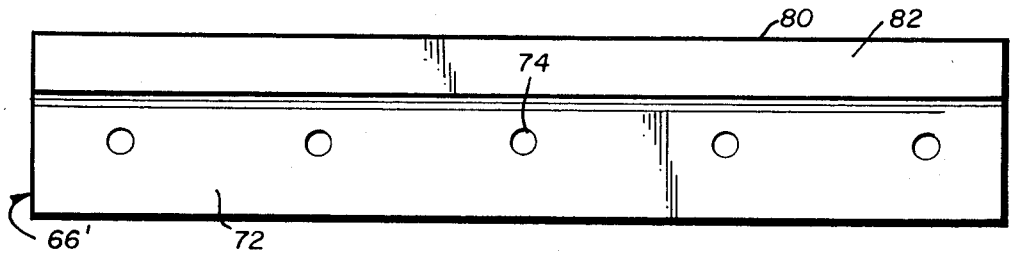
FIGS. 9, 10 and 11 are respective top plan, rear elevational and right end elevational views of a cover tee assembly thereof.
Figure 10:
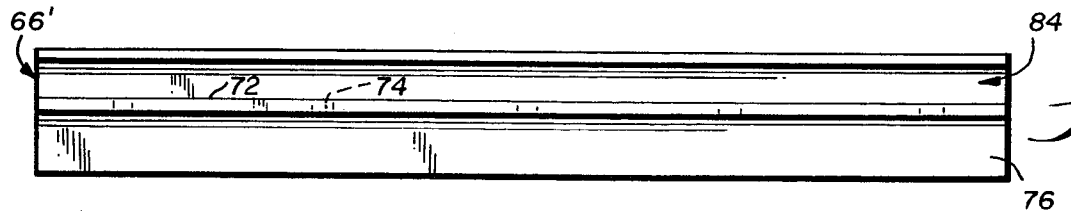
Figure 11:
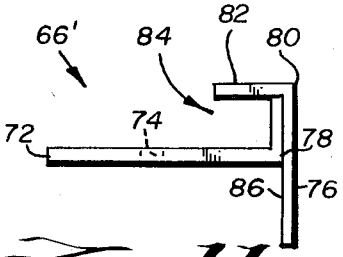

As shown in FIGS. 6, 7 and 8 the system 48' further includes a pair of end brackets 64'. The right end bracket 64 is shown in these figures; the left end bracket is a mirror image of it. Each end bracket 64' is shown provided on its main, vertical flange 86 with openings 88 which permit the brackets to be attached, e.g. by screws on the inner faces of the end walls 12, 14 (FIG. 1) of the case 10, in the opposite front upper corners of the case. Each flange 86 includes a generally triangular portion 90 which is constructed and arranged to serve as a respective end of the wiring raceway 60', and an upper, turned-in tab 92 having a horizontal orientation and an opening 94 formed vertically therethrough for screwed, bolted or similar attachment to respective end portions of the cover tee assembly 66' in order to cooperatively form with the cover tee assembly a means for securely but unobstrusively mounting the shell assembly 56'/58' to the case 10. The end brackets 64' preferably are made of stainless steel.

The shell assembly 56'/58' is shown assembled of an inner shell 56' formed as an extrusion of aluminum, telescopically condensed into an outer shell 58' preferably formed by bending stainless steel sheet.

The inner shell 56' includes a depending vertical frontal flange 96, and a rearwardly extending upper horizontal flange 98 joined therewith along a common front, top edge 100. Intermediate their downward and rearward extents, respectively, the flanges 96 and 98 are provided with additional flange means 102 defining opposed grooves 104 which open towards one another in a common plane that forms a hypotenuse a triangle with the flanges 96 and 98. To the rear of the base of the additional flange means 102 on the horizontal flange 98, a rear marginal portion of the flange 98 is angled down, e.g. at about a thirty-degree angle, e.g. to shield the clerk's eyes from the direct light of the lamps without the shell assembly 56'/58' having to project so far to the rear as it otherwise would have to.

The outer shell 58', in essence, wraps about and superficially corresponds to the exterior of the inner shell 56', curling about its edges 104, 106 at 108 and 110. By preference, the inner shell 56' is made as an aluminum extrusion and the outer shell 58' is made of stainless steel. These elements are preferably mirror-polished at 70' in order to serve as a reflector for the lamps. The insert means 54' preferably is constituted by a plurality of individual plates of aluminum mirror-polished on their face 112 for helping to constitute a reflector for the lamps 52.

Each lamp 52, typically a Norelco PL*13 single base compact fluorescent lamp is mounted in a socket 50, typically a Leviton catalog No. 26720-2 horizontal screw or slide-on mount lamp holder which is slid onto an edge of or otherwise secured to a respective insert plate 54'; a shorter end piece 54'' may be provided for mounting the last socket 50 in the series and/or as a space filler.

Each socket 50 is typically provided with two wires, e.g. a neutral, white wire 114, and a hot, black wire 116. These wires are led from each socket back between gapped ends of adjacent inserts 54', where (as may be apparent from FIG. 13, the white wires 114 are connected together e.g. using a white jumper wire, so that only one neutral wire must be led to the ballast box).

As the inserts 54', 54'' are slid into the opposing grooves 104 of the inner shell, they generally close the hypotenuse slide of raceway 60'; (except for the gaps between plates where the wiring 114, 116 extends from each socket into the raceway). Within the raceway 60', the collected wiring 114, 116 is led to one end, where it exits, e.g. at 118, into a flexible conduit 120 which may be buried in a slot or other raceway (not shown) in a respective endwall 12 or 14 of the case 10. The wiring 114, 116 extends in the conduit 120 down, out of sight into the storage or base area of the case 10, where a ballast box 122 is provided. In the ballast box 122, there is mounted a ballast 124 (e.g. a Radonic model C452 ballast) for each lamp. Each such ballast has two wires, typically a black wire 126 and a blue wire 128. A three conductor electric power cord 130 with a three prong plug 132 on one end, is also brought to the ballast box; the power cord 130 typically has a white wire 114', a black wire 116' and a green or ground wire 134. Conventional connectors 136, 138 are provided where the flexible conduit and power cord mechanically penetrate the ballast box wall, as shown. In the ballast box, the common neutral wire 114 from the lamp socket is mechanically and electrically connected to the neutral wire 114' of the electrical power cord 130, e.g. using a standard connector 140 such as a wirenut connector. Similarly, each black wire 116 from a respective socket 50 is connected to the blue wire 128 of a respective ballast 124 at 142, and the black wires 126 from the ballasts are connected to the black wire 116' of the power cord 130 at 144. The ground wire 134 is connected to the housing of the ballast box.

The ballast box is shown provided with a removable cover plate 146 in case access to the box for replacement is needed.

The power cord 130 is led out of the case 10 either to an electrical outlet, or to a continuation provided in the base of an adjoining case 10, and thereby indirectly to an electrical outlet.

As the case is assembled, the end brackets 64' and cover tee assembly 66' central flange are screwed to the upper, horizontal flange of the shell assembly 56/58 similarly to the showing in FIG. 2 for simultaneously mounting the light rail 150 of the lighting system 48' to the case and forming a holding channel for the upper marginal edge of the front glass of the display case.

Although the apparatus of the invention has been illustrated in connection with a showcase, it is equally applicable to a center island displayer that is accessible to the customer from both sides, and to wall cabinets and other display cases.

The system of the invention provides a high intensity of light, from an economical, compact source, with very little heat being generated.

It should now be apparent that the display case lighting system as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

We claim:

1. A display case lighting system for providing a display space of a display case for jewelry or the like with a high intensity, economically operable, compact light source which can provide generally even illumination over the length of the display space, while generating little heat, said lighting system, comprising:

a light bar for at least one single base compact fluorescent lamp said light bar including a shell means including a front flange and a rearwardly extending flange which join at a common front edge at generally a right angle, channel means provided rearwardly on each of said front flange and rearwardly extending flange, these channel means opening toward one another and being constructed and arranged to slidingly receive insert plate means;

at least one lamp holder for a single base compact fluorescent lamp;

each said lamp base being mounted to an insert plate means and having electrical wiring extending to a rear side of said insert plate means;

said insert plate means being slidingly received in said channel means thereby forming with said shell means a raceway for said electrical wiring;

means for securing said light bar in a display case so as to extend substantially lengthwise of the case;

a ballast means, including a housing, mounted in said housing a ballast for each lamp of the light bar; an electrical power cord for connecting the ballasts to a source of electrical power and electrical wiring extending from the ballasts to electrically connect with said electrical wiring of each said lamp holder, said ballast means being constructed and arranged to be unobtrusively mounted to the display case.

2. The display case lighting system of claim 1, wherein:

said channel means face one another in a plane which is oblique to said flanges of said shell means, and said insert plate means is generally flat, thus forming a raceway of generally triangular transverse cross-sectional shape.

3. The display case lighting system of claim 1, wherein:

said shell means comprises an inner shell formed as an integral extrusion and an outer decorative shell of polished metal.

4. The display case lighting system of claim 1, wherein:

said securing means comprises a cover tee assembly constructed and arranged to project into a display case between the top glass and a front glass of the display case, to have means defining a first channel for receiving an edge margin of one said glass, to have means cooperatively defining with said shell means a second channel for receiving an edge margin of the other said glass, and means for securing said cover tee assembly to said shell means.

5. The display case lighting system of claim 4, further comprising:

a pair of end brackets constructed and arranged to be secured on opposite end walls of a display case and to have said shell means connected thereto at opposite ends of said shell means, within the display space of the display case.

6. The display case lighting system of claim 1, wherein:

said shell means and said insert plate means include polished surface means constructed and arranged to serve as a reflector for each said lamp, while normally shielding customers and clerks and other viewers outside the case from direct viewing of each said lamp.

7. The display case lighting system of claim 1, wherein:

said insert plate means comprises a series of individual plates having said wiring passing between them into said raceway.

* * * * *